US007426844B2

(12) United States Patent
Brandenfels et al.

(10) Patent No.: US 7,426,844 B2
(45) Date of Patent: Sep. 23, 2008

(54) DEVICE FOR LOADING THE GUIDE SURFACES OF BEARING CHOCKS SUPPORTED IN THE HOUSING WINDOWS OF ROLLING STANDS

(75) Inventors: Peter Brandenfels, Hilchenbach (DE); Frank Benfer, Bad Laasphe (DE); Matthias Kipping, Herdorf (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 11/629,156

(22) PCT Filed: Jun. 8, 2006

(86) PCT No.: PCT/EP2006/005485

§ 371 (c)(1),
(2), (4) Date: Dec. 8, 2006

(87) PCT Pub. No.: WO2006/131361

PCT Pub. Date: Dec. 14, 2006

(65) Prior Publication Data

US 2007/0245794 A1 Oct. 25, 2007

(30) Foreign Application Priority Data

Jun. 8, 2005 (DE) ..... 10 2005 026 257
Sep. 6, 2005 (DE) ..... 10 2005 042 168

(51) Int. Cl.
*B21B 31/02* (2006.01)

(52) U.S. Cl. ..... 72/10.1; 72/12.1; 72/13.4; 72/237; 72/365.2

(58) Field of Classification Search ..... 72/10.1, 72/7.1, 8.2, 9.5, 10.6, 12.1, 13.4, 241.8, 237, 72/245, 365.2
See application file for complete search history.

(56) References Cited

U.S. PATENT DOCUMENTS

| | | | | |
|---|---|---|---|---|
| 3,302,435 | A * | 2/1967 | Lyle et al. | 72/245 |
| 3,795,124 | A * | 3/1974 | Diolot | 72/13.3 |
| 4,116,028 | A * | 9/1978 | Okamoto et al. | 72/10.6 |
| 4,487,044 | A * | 12/1984 | Fapiano | 72/10.6 |
| 4,570,472 | A * | 2/1986 | Kuwano | 72/8.4 |
| 5,029,400 | A * | 7/1991 | Leclercq et al. | 33/657 |
| 5,448,901 | A * | 9/1995 | Yu et al. | 72/7.2 |
| 5,768,927 | A * | 6/1998 | Kajiwara et al. | 72/10.1 |
| 6,354,128 | B1 * | 3/2002 | Donini et al. | 72/237 |
| 6,510,721 | B1 * | 1/2003 | Yamamoto et al. | 72/245 |
| 7,111,486 | B2 * | 9/2006 | Figge | 72/245 |
| 2003/0024292 | A1 * | 2/2003 | Yamamoto et al. | 72/245 |

FOREIGN PATENT DOCUMENTS

| | | |
|---|---|---|
| EP | 1 036 605 | 9/2000 |
| WO | 02/47836 | 6/2002 |

OTHER PUBLICATIONS

English Abstract for EP 1036605, Sep. 20, 2000.*

* cited by examiner

*Primary Examiner*—Dmitry Suhol
(74) *Attorney, Agent, or Firm*—Friedrich Kueffner

(57) ABSTRACT

A device for loading the guide surfaces of bearing chocks (LS) supported in the housing windows (SF) of rolling stands with pressure plates (DP) that can be placed on the guide surfaces and that can be loaded by a hydraulic piston (K) supported in the rolling stand housings (ST), wherein devices for measuring the pressure and devices (WM) for measuring the displacement of the piston are assigned to the hydraulic piston (K), and wherein the frictional force is eliminated by adjusting well-defined clearances between the bearing chocks (LS) and the guide surfaces.

2 Claims, 3 Drawing Sheets

DEVICE FOR LOADING THE GUIDE SURFACES OF BEARING CHOCKS SUPPORTED IN THE HOUSING WINDOWS OF ROLLING STANDS

The invention concerns a device for loading the guide surfaces of bearing chocks supported in the housing windows of rolling stands with pressure plates that can be placed on the guide surfaces and that are loaded by hydraulic piston-cylinder units installed in the rolling stand housings. Devices of this type are disclosed, for example, in EP 1 036 605 and EP 1 281 449, in which the hydraulic piston-cylinder units are installed in recesses of the rolling stand housing, and each cylinder-piston supports a pressure plate on its end face that faces the housing window and the given lateral guide surface of the bearing chocks. This device makes it possible, by varying the hydraulic pressure loading of the piston, to produce well-defined contact forces and thus frictional forces on the bearing chocks while bridging the working clearance, i.e., to predetermine well-defined contact forces and frictional forces, independently of the rolling conditions. As described in the above-cited document EP Patent 1 036 605, the contact forces give rise to frictional forces, which have the same line of action as the rolling force. Even when the contact forces are held constant, there is no guarantee that the frictional forces also remain constant, because the coefficient of friction between the contact surfaces of the bearing chocks and the housing window changes due to the changes in the surface quality. The surface of the contact surfaces becomes rougher due to corrosion, cooling water, or other abrasive substances. The coefficient of friction rises, and therefore the frictional forces T also rise and thus can be determined only inexactly. Regardless of whether the frictional forces can be determined or not, they have an adverse effect on the ability to regulate or automatically control the rolling stands. Consequently, the rolling force acting directly in the roll gap cannot be exactly determined. However, the current strip thickness in the roll gap can be computed by the gage control equation only from this force that acts directly in the roll gap. As a result, the strip thickness tolerances and strip flatness tolerances are difficult to maintain. The design solution according to the documents cited above also does not make it possible to determine where the center planes of the bearing chocks in the housing window are located with respect to a fixed plane and how the position of the center planes varies relative to this fixed plane. This deficiency also means that unintended crossing of the rolls relative to one other cannot be determined.

The objective of the invention is to eliminate these disadvantages that impair the rolling process. This objective is achieved by assigning pressure-measuring and position-measuring devices that can be controlled by automatic controlling devices to each hydraulic cylinder. These automatic controls can operate in such a way that the piston maintains a predetermined position regardless of the force acting on it or in such a way that at a certain force acting on the piston, the piston is displaced and enters a different, specific position. The automatic controls can also operate in such a way that the bearing chock is pressed against a fixed side of the housing window with a certain force. The displacement sensor then shows no further changes. If the piston of the cylinder is then moved a predetermined amount in the opposite direction, then a well-defined clearance of the bearing chocks in the housing window will be established. This type of clearance adjustment can compensate the production tolerances of the different bearing chocks, the wear, and the housing constriction due to the rolling forces to be expected. As the result of the adjustment of optimum clearance, no contact forces of the piston come into play, and no frictional forces are produced which have a negative effect on the automatic controllability of the process.

With the position of the housing window sides known, the position of the bearing chocks relative to a selected plane can be determined by the pressing and simultaneous measurement of the piston stroke made on the drive side and on the tending side of the rolls. If this position measurement is compared with previously stored position measurements, the wear on the housing windows and their mounting parts can be determined. If, as described, the piston is installed in such a way that two pistons are present per roll and they press against a fixed surface via the bearing chocks, the crossing of the rolls can be determined in this way. Evaluation of the measured values makes it possible to determine the position of all of the rolls relative to one another. If a piston is provided for each bearing chock on each side, the run-in side and runout side and the drive side and tending side, the rolls can be systematically crossed relative to one another by means of this position measurement. For example, the upper work roll and the upper backup roll can be set parallel to each other and crossed with respect to the lower work roll and the lower backup roll, which are themselves set parallel to each other. This crossing of the upper roll relative to the lower roll can then be used to influence the profile and flatness. With the use of this integrated position measurement, which measures directly in or on the moving members, the rolls can be exactly positioned.

The invention is explained in greater detail with reference to the specific embodiments illustrated in the drawings.

Figure 1:
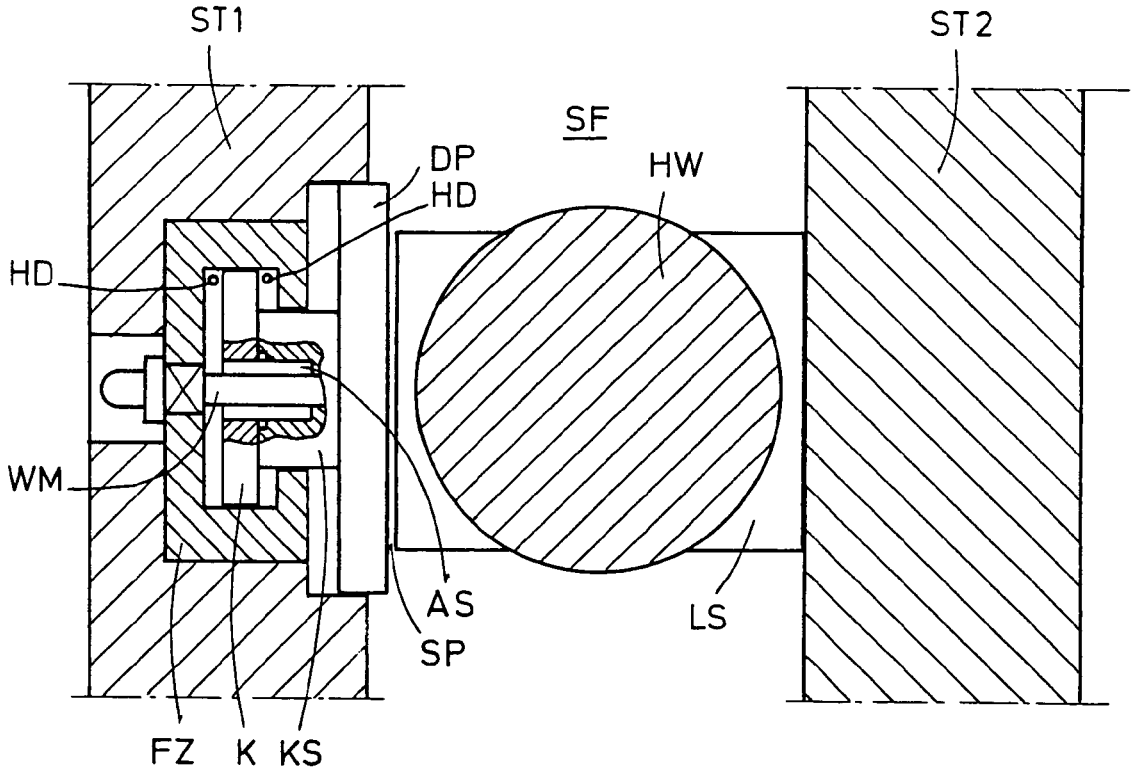
FIG. 1 shows a schematic partial section through a rolling stand in a side view.

As FIG. 1 shows, the bearing chock LS for the horizontal roll HW is supported in the housing window SF between the two housing posts ST1 and ST2 of a rolling stand. In the left housing post ST1, there is a piston-cylinder unit, which has a guide cylinder FZ and a piston K with a piston rod KS that moves in the cylinder. A pressure plate DP is supported on the end face of the piston rod KS in the left housing post ST1. The piston K and piston rod KS have a central recess AS, into which extends a displacement sensor WM, which is mounted on the outer rear wall of the guide cylinder FZ. Hydraulic pressure lines HD, which have a pressure-measuring device (not shown), open into the guide cylinder FZ on both sides of the piston K.

Figure 2:
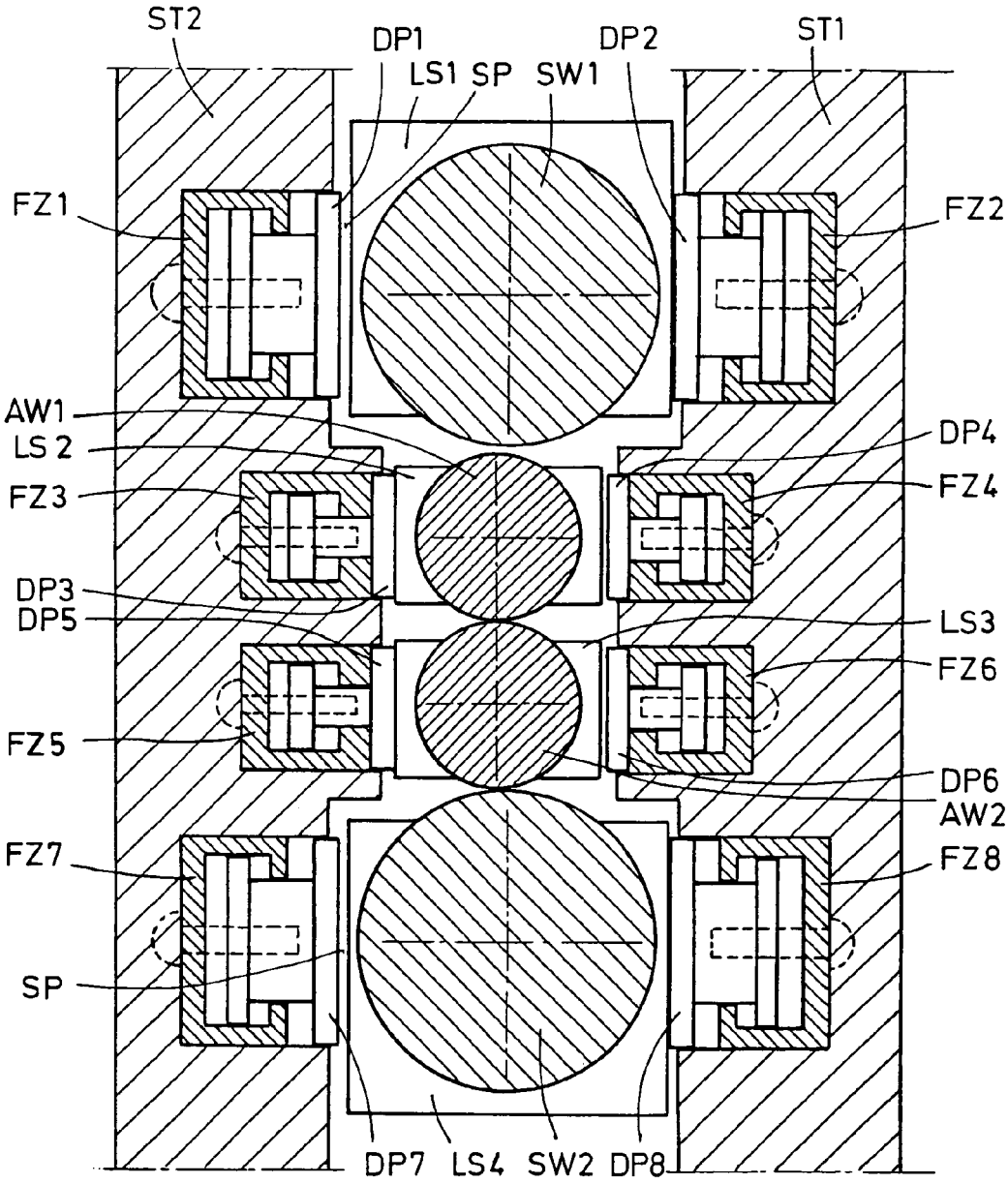
FIG. 2 shows the same type of partial section as FIG. 1 but through a different rolling stand.

In the design according to FIG. 2, which shows a four-high rolling stand with horizontal backup rolls SW1 and SW2 and their associated work rolls AW1 and AW2, guide cylinders FZ1, FZ2, FZ3, FZ4, FZ5, FZ6, FZ7 and FZ8, which have the same design as the guide cylinder FZ in FIG. 1, are installed on both sides of the rolls in both housing posts ST1 and ST2. All of these guide cylinders have a piston K, piston rod KS, and displacement sensor WM and can be pressure-controlled and position-controlled by means of pressure lines (not shown), which correspond to the pressure lines HD in FIG. 1. A clearance gap SP is provided between the pressure plates DP1, DP2 and the bearing chock LS1 and between the pressure plates DP7, DP8 and the bearing chock LS4.

Figure 3:
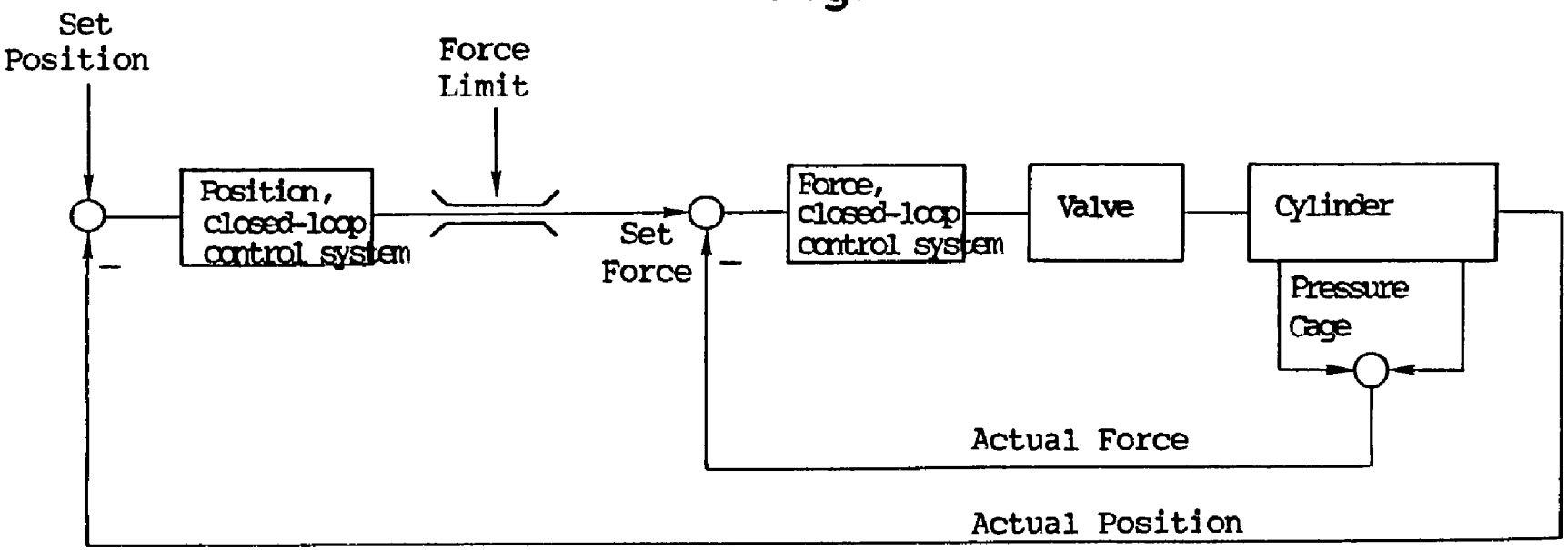
FIG. 3 shows a control diagram.

In accordance with the control diagram in FIG. 3, each cylinder is moved with a valve until it reaches the predetermined position set value. If the adjustable force limit is reached during this movement, the operation is interrupted.

The rolling stand designs according to both FIG. 1 and FIG. 2 with automatic control systems according to FIG. 3 make it possible, as explained above, to determine and evaluate the position of all of the rolls of the stand relative to one another by means of pressing the pressure plates and measurement of the stroke moved in each case in selected stand sections and comparison of these measured values with previously stored values.

LIST OF REFERENCE SYMBOLS

SF housing window
ST1 housing post (left)
ST2 housing post (right)
LS bearing chock
HW horizontal rolls
FZ guide cylinder
K piston
KS piston rod
DP pressure plate
AS recess
WM displacement sensor
ES adjustable clearance
HD (hydraulic) pressure lines
SW1 backup roll
SW2 backup roll
AW1 work roll
AW2 work roll
LS1 bearing chock
LS2 bearing chock
LS3 bearing chock
LS4 bearing chock
FZ1 guide cylinder
FZ2 guide cylinder
FZ3 guide cylinder
FZ4 guide cylinder
FZ5 guide cylinder
FZ6 guide cylinder
FZ7 guide cylinder
FZ8 guide cylinder
DP1 pressure plate
DP2 pressure plate
DP3 pressure plate
DP4 pressure plate
DP5 pressure plate
DP6 pressure plate
DP7 pressure plate
DP8 pressure plate
SP clearance gap

The invention claimed is:

1. A method for operating a device for loading guide surfaces of bearing chocks supported in housing windows of rolling stands with pressure plates that can be placed on the guide surfaces and that can be loaded by hydraulic piston-cylinder units supported in the rolling stand housings, wherein devices for measuring pressure and devices (WM) for measuring displacement of the piston are assigned to the hydraulic piston wherein, by pressing the pressure plates against the bearing chocks and measuring a piston stroke towards the bearing chocks on a tending side and a drive side of the roll, a position of the roll is determined and stored, and then wear on the housing windows of the rolling stand is determined by comparing measured values with previously stored values.

2. A method according to claim 1, wherein frictional force is eliminated by adjusting well-defined clearances between the bearing chocks and the guide surfaces.

* * * * *